US006565616B1

(12) United States Patent
Krull et al.

(10) Patent No.: US 6,565,616 B1
(45) Date of Patent: May 20, 2003

(54) COPOLYMER BLENDS AND THEIR USE AS ADDITIVES FOR IMPROVING THE COLD FLOW PROPERTIES OF MIDDLE DISTILLATES

(75) Inventors: Matthias Krull, Oberhausen (DE); Thomas Volkmer, Wiesbaden (DE); Werner Reimann, Frankfurt (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/808,454

(22) Filed: Mar. 14, 2001

(30) Foreign Application Priority Data

Mar. 14, 2000 (DE) ..... 100 12 267

(51) Int. Cl.[7] ..... C10L 1/18

(52) U.S. Cl. ..... 44/329; 44/340; 44/341; 44/346; 44/393; 525/203; 525/207; 525/222; 525/225; 525/227; 525/228; 525/229

(58) Field of Search ..... 44/329, 340, 341, 44/346, 393; 525/203, 205, 207, 222, 225, 227, 228, 229

(56) References Cited

U.S. PATENT DOCUMENTS

| | | | | |
|---|---|---|---|---|
| 2,542,542 A | | 2/1951 | Lippincott et al. | |
| 3,394,114 A | * | 7/1968 | Anderson | |
| 3,562,229 A | * | 2/1971 | Bauer et al. | |
| 4,670,516 A | | 6/1987 | Sackmann et al. | 525/327.6 |
| 4,985,048 A | | 1/1991 | Wirtz et al. | |
| 5,254,652 A | * | 10/1993 | Reimann et al. | 526/331 |
| 5,767,190 A | | 6/1998 | Krull et al. | 524/563 |
| 6,110,238 A | | 8/2000 | Krull et al. | |
| 2001/0034968 A1 | | 11/2001 | Krull et al. | |

FOREIGN PATENT DOCUMENTS

| | | |
|---|---|---|
| CA | 2242428 | 1/1999 |
| DE | 1147799 | 1/1963 |
| DE | 1 914 756 | 11/1969 |
| DE | 35 14 878 | 11/1986 |
| EP | 0 153 176 | 8/1985 |
| EP | 0 154 177 | 9/1985 |
| EP | 0 214 786 | 3/1987 |
| EP | 0 271 738 | 6/1988 |
| EP | 0 320 766 | 6/1989 |
| EP | 0 807 642 | 11/1997 |
| EP | 0 890 589 | 1/1999 |
| EP | 0 890 633 | 1/1999 |
| EP | 0 931 824 | 7/1999 |
| GB | 913 715 | 12/1962 |
| GB | 1 468 588 | 3/1977 |
| GB | 1 469 016 | 3/1977 |

OTHER PUBLICATIONS

Derwent Patent Family Abstract for DE 1 914 756.
Römpp: Chemie Lexikon, Thieme Verllag, 9 Auflage, p. 4884–4901.
Derwent Patent Family Abstract for DE 35 14 878.
Derwent Patent Family Abstract for EP 0 271 738.

* cited by examiner

*Primary Examiner*—Ana Woodward
(74) *Attorney, Agent, or Firm*—Richard P. Silverman

(57) ABSTRACT

The invention relates to blends of copolymers containing structural units of olefins, derivatives of dibasic carboxylic acids and, if required, polyolefins and, structural units of ethylene and vinyl esters of tertiary carboxylic acids, and their use as additives to fuel oils for improving their cold flow properties.

12 Claims, No Drawings

COPOLYMER BLENDS AND THEIR USE AS ADDITIVES FOR IMPROVING THE COLD FLOW PROPERTIES OF MIDDLE DISTILLATES

BACKGROUND OF THE INVENTION

The present invention relates to blends of copolymers, on the one hand containing structural units of olefins, derivatives of dibasic carboxylic acids and, if required, polyolefins and, on the other hand, containing structural units of ethylene and vinyl esters of tertiary carboxylic acids, and their use as additives to fuel oils for improving their cold flow properties.

Depending on the origin of the crude oils, crude oils and middle distillates, such as gas oil, diesel oil or heating oil, obtained by distillation of crude oils contain different amounts of n-paraffins, which, when the temperature decreases, crystallize out as lamellar crystals and agglomerate, in some cases with inclusion of oil. Consequently, there is a deterioration in the flow properties of these oils or distillates, with the result that problems may occur, for example, in the production, transport, storage and/or use of the mineral oils and mineral oil distillates. When mineral oils are transported through pipelines, this crystallization phenomenon can lead, especially in winter, to deposits on the pipe walls and in individual cases, for example when a pipeline is shut down, even to complete blockage thereof. The precipitation of paraffins can also cause difficulties during the storage and further processing of mineral oils. Under certain circumstances, it may therefore be necessary in winter to store the mineral oils in heated tanks. In the case of mineral oil distillates, blockage of the filters in diesel engines and furnaces may occur as a consequence of the crystallization, with the result that safe metering of the fuels is prevented and the supply of fuel or heating medium may be completely stopped.

In addition to the traditional methods for eliminating the paraffins which have crystallized out (thermal, mechanical or by means of solvents), which relate only to the removal of the already formed precipitates, recent years have seen the development of chemical additives (so-called flow improvers or paraffin inhibitors) which cooperate physically with the precipitating paraffin crystals and thus modify their shape, size and adhesion properties. The additives act as additional crystal nuclei and partly crystallize out with the paraffins, resulting in a larger number of smaller paraffin crystals having a modified crystal shape. A part of the effect of the additives is also explained by dispersing of the paraffin crystals. The modified paraffin crystals have less tendency to agglomeration, so that the oils into which these additives have been introduced can be pumped and processed even at temperatures which are often more than 20° C. lower than in the case of oils without additives.

The flow behavior and low-temperature behavior of mineral oils and mineral oil distillates is described, inter alit, by stating the cloud point (determined according to ISO 3015), the pour point (determined according to ISO 3016) and the cold filter plugging point (CFPP; determined according to EN 116). These characteristics are measured in ° C.

Typical flow improvers for crude oils and middle distillates are copolymers of ethylene with carboxylic esters of vinyl alcohol. Thus, according to DE-A-11 47 799, oil-soluble copolymers of ethylene and vinyl acetate having a molecular weight of from about 1000 to 3000 are added to power fuels and heating fuels having a boiling point of from about 120 to 400° C. and obtained from mineral oil distillates. Copolymers which contain from about 60 to 99% by weight of ethylene and from about 1 to 40% by weight of vinyl acetate are preferred. They are particularly effective if they are prepared by free radical polymerization in an inert solvent at temperatures of from about 70 to 130° C. and pressures of from 35 to 2100 atm (gage pressure) (DE-A-19 14 756).

The prior art furthermore discloses so-called comb polymers which are derived from ethylenically unsaturated monomers having relatively long (e.g. $C_8$–$C_{30}$), preferably linear, alkyl radicals. These are used especially in relatively high-boiling paraffin-rich mineral oils, if necessary in combination with ethylene copolymers, for improving the cold flow properties (e.g. GB-A-1 469 016 and EP-A-0 214 786). According to EP-A-0 153 176, comb polymers having $C_{12}$–$C_{14}$-alkyl radicals are also used in narrow-cut distillates having for example (90–20) % distillation ranges of <100° C. and final boiling points of about 340–370° C. According to U.S. Pat. No. 2,542,542 and GB-A-1 468 588, copolymers of maleic anhydride (MAA) and α-olefins, esterified with long-chain fatty alcohols, are used for the treatment of crude oils.

GB-A-14 69 016 describes the use of blends of ethylene copolymers with comb polymers which are derived from $C_6$–$C_{18}$-esters of ethylenically unsaturated dicarboxylic acids and olefins and vinyl esters for improving the cold flow properties of middle distillates.

DE-A-35 14 878 describes esterification products of copolymers of maleic anhydride with olefinically unsaturated monomers (olefins, in particular ethylene, and acrylic acid) and primary or secondary alcohols having 16–30 carbon atoms as pour point depressants for paraffin-containing mineral oils. These products have an acid number of less than 20 mg KOH/g.

EP-A-0 214 786 describes middle distillate additives comprising maleic anhydride and straight-chain 1-olefins, which are esterified with fatty alcohols by a polymer-analogous reaction, for improving the cold flow properties of middle distillates.

EP-A-0 320 766 describes polymer blends comprising a copolymer (A1) of 10–60% by weight of vinyl acetate or a copolymer (A2) of 15–50% by weight of vinyl acetate, 0.5–20% by weight of $C_6$–$C_{24}$-alpha-olefin and 15.5–70% by weight of ethylene and a copolymer (B) of 10–90% by weight of $C_6$–$C_{24}$-alpha-olefin and 10–90% by weight of N–$C_6$–$C_{22}$-alkylmaleimide, the mixing ratio of the copolymers (A1) or (A2) to (B) being from 100:1 to 1:1. These polymer blends are used as flow improvers in middle distillates.

EP-A-0 890 589 describes the use of ethylene/vinyl neocarboxylate copolymers for improving the cold flow properties of middle distillates having an extremely low cloud point and a narrow boiling range, it also being possible for comb polymers to be present.

EP-A-0 931 824 describes blends of ethylene/vinyl neocarboxylate copolymers with further ethylene copolymers having a comonomer content of 10–20 mol %. These may furthermore contain comb polymers.

SUMMARY OF THE INVENTION

With increasing depletion of the world's oil reserves, increasingly heavy and hence paraffin-rich crude oils are being produced and processed. The distillates prepared therefrom contain increasing amounts of n-paraffins, whose distribution is shifting to increasingly long alkyl chains. Particularly problematic here is the high content of long-chain n-paraffins having carbon chain lengths of 22 or more.

Such oils are also treated using combinations of ethylene-based flow improvers with comb polymers, whose efficiency, however, is often insufficient. There is therefore an increasing need for more efficient additives for the treatment of heavy and paraffin-rich middle distillates.

Surprisingly, it has now been found that blends of at least 2 polymers, which contain copolymers of ethylene and vinyl esters of tertiary carboxylic acids and specific comb polymers, are substantially more suitable for improving the cold flow properties of heavy, paraffin-rich middle distillates than the cold flow improvers of the prior art.

The invention relates to additives for improving the cold flow properties of middle distillates, containing from 10 to 95% by weight of copolymers A), from 5 to 90% by weight of copolymers B) and, if required, from 0 to 70% by weight of copolymers C), which correspond to the following formulae:

A) copolymers of lower olefins and vinyl esters, containing

A1) from 85 to 97 mol % of bivalent structural units of the formula $$—CH_2—CR^1R^2— \quad \text{A1}$$

in which $R^1$ and $R^2$, independently of one another, are hydrogen or methyl, and A2) at least 3 mol % of bivalent structural units of the formula

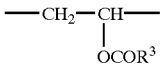

A2 in which $R^3$ is saturated, branched $C_6$–$C_{16}$-alkyl which has a tertiary carbon atom, wherein $R^3$ is bonded with its tertiary carbon atom to the carboxyl function, B) copolymers comprising B1) from 40 to 60 mol % of bivalent structural units of the formula

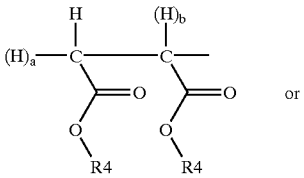

B1 a)

or

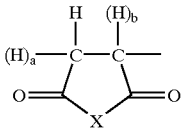

B1 b)

where X is O or N—$R^4$ and in which a and b are 0 or 1 and a+b=1, and

B2) from 60 to 40 mol % of bivalent structural units of the formula $$—H_2C—CHR^5— \quad \text{B2}$$

and, if required,

B3) from 0 to 20 mol % of bivalent structural units which are derived from polyolefins, the polyolefins being derivable from monoolefins having 3 to 5 carbon atoms and wherein a) $R^4$ is an alkyl or alkenyl radical having 10 to 40 carbon atoms or an alkoxyalkyl radical having 1 to 100 alkoxy units and 1 to 30 carbon atoms in the alkyl radical and b) $R^5$ is an alkyl radical having 10 to 50 carbon atoms and c) the number of carbon atoms of the polyolefin molecules on which the structural units B3) are based is from 35 to 350, and, if required, C) a further copolymer differing from A) and B) and comprising ethylene and one or more vinyl esters or acrylates, which by itself is effective as a cold flow improver for middle distillates.

The invention furthermore relates to the use of the additives according to the invention for improving the cold flow properties of fuel oils.

The invention furthermore relates to fuel oils which contain the additives according to the invention.

Below, the term polymer blend is used in the meaning of the additive according to the invention.

In formula A1), $R^1$ and $R^2$ are preferably hydrogen. In particular, these are copolymers of ethylene, up to 10 mol %, in particular up to 5 mol %, being capable of being replaced by lower olefins, such as propene and/or butene. In formula A2), $R^3$ is preferably a neoalkyl radical having 7 to 11 carbon atoms, in particular a neoalkyl radical having 8, 9 or 10 carbon atoms.

The copolymer A) according to the invention preferably comprises not more than 15, in particular from 5 to 10, mol % of structural units of the formula A2). Particularly preferred copolymers A) are those having from 5 to 9 mol % of vinyl neononanoate or vinyl neodecanoate as structural unit A2).

The copolymers A) according to the invention can be prepared by conventional copolymerization processes, such as, for example, suspension polymerization, solution polymerization, gas-phase polymerization or high-pressure mass polymerization. High-pressure mass polymerization at pressures of preferably from 50 to 400, in particular from 100 to 300, MPa and temperatures of preferably from 50 to 300, in particular from 100 to 250, ° C. is preferred. The reaction of the monomers is initiated by free radical initiators (free radical chain initiators). This class of substance includes, for example, oxygen, hydroperoxides, peroxides and azo compounds, such as cumyl hydroperoxide, tert-butyl hydroperoxide, dilauroyl peroxide, dibenzoyl peroxide, bis(2-ethylhexyl) peroxodicarbonate, tert-butyl perpivalate, tert-butyl permaleate, tert-butyl perbenzoate, dicumyl peroxide, tert-butyl cumyl peroxide, di(tert-butyl) peroxide, 2,2'-azobis(2-methylpropanonitrile) and 2,2'-azobis(2-methylbutyronitrile). The initiators are used individually or as a mixture of two or more substances, in amounts of from 0.001 to 20% by weight, preferably from 0.01 to 10% by weight, based on the monomer mixture.

Preferably, the copolymers A) according to the invention have melt viscosities at 140° C. of from 20 to 10,000 mPas, in particular from 30 to 5000 mPas, especially from 50 to 2000 mPas.

The desired melt viscosity of the copolymers A) is established, for a given composition of the monomer mixture, by varying the reaction parameters of pressure and temperature and, if required, by adding moderators. Hydrogen, saturated or unsaturated hydrocarbons, e.g. propane, aldehydes, e.g. propanealdehyde, n-butyraldehyde or isobutyraldehyde, ketones, e.g. acetone, methyl ethyl ketone, methyl isobutyl ketone or cyclohexanone, or alcohols, e.g. butanol, have proven to be useful moderators. Depending on the desired viscosity, the moderators are used in amounts of up to 20% by weight, preferably from 0.05 to 10% by weight, based on the monomer mixture.

The comonomers suitable for the preparation of the copolymers A) according to the invention are in particular vinyl neooctanoate, neononanoate, neodecanoate, neoundecanoate and neododecanoate. These esters can be prepared, for example, by vinylation of the neocarboxylic acids obtainable from olefins, CO and $H_2O$ by the Koch carboxylic acid synthesis (Römpp: Chemie-Lexikon, Thieme-Verlag, 9th Edition, pages 4881 and 4901).

The copolymers A) according to the invention may contain up to 4% by weight of vinyl acetate or up to 5 mol % of further comonomers. Suitable comonomers are, for example, vinyl esters of lower carboxylic acids, such as vinyl propionate and vinyl butyrate, vinyl ethers, such as vinyl methyl ether and vinyl ethyl ether, alkyl (meth) acrylates of $C_1$–$C_4$-alcohols, such as methyl acrylate, ethyl acrylate, propyl acrylate, n-butyl, isobutyl and tert-butyl acrylate and the corresponding esters of methacrylic acid, and higher olefins having at least 5 carbon atoms. Preferred higher olefins are hexene, 4-methylpentene, norbornene, octene and diisobutylene.

In order to obtain copolymers of the composition stated under A), monomer mixtures which contain from 1 to 50% by weight, preferably from 3 to 40% by weight, of vinyl esters in addition to ethylene and, if required, a moderator are used. The different copolymerization factors of the monomers are taken into account by means of the different composition of the monomer mixture compared with the composition of the copolymer. The polymers are obtained as colorless melts which solidify to waxy solids at room temperature.

The high-pressure mass polymerization is carried out batchwise or continuously in known high-pressure reactors, e.g. autoclaves or tubular reactors, tubular reactors having proven particularly useful. Solvents, such as aliphatic and/or aromatic hydrocarbons or hydrocarbon mixtures, benzene or toluene, may be contained in the reaction mixture. The solvent-free procedure is preferred. In a preferred embodiment of the polymerization, the mixture of the monomers, the initiator and, if used, the moderator is fed to a tubular reactor via the reactor entrance and via one or more side branches. Here, the monomer streams may have different compositions (EP-A-0 271 738).

The structural units of the compounds of the formula B1) are derivatives of maleic, fumaric or itaconic acid. Preferably, $R^4$ is an alkyl radical of, preferably, 10 to 24, in particular 12 to 20, carbon atoms.

In addition to the use of individual alcohols $R^4$-OH for the esterification, the use of alcohol mixtures, for example of dodecanol and tetradecanol or tetradecanol and hexadecanol, in the ratio 1:10 to 10:1, in particular 3:1 to 1:3, has proven particularly useful here. By varying the alcohol component, the additive can be adapted to the oil to be treated. Thus, for example by adding 15% by weight of behenyl alcohol to the abovementioned mixtures, the efficiency in oils having an extremely high final boiling point of >390° C., in particular >410° C., can be optimized. The radicals $R^4$ may be linear or branched, it being possible for the branching to comprise a secondary or tertiary carbon atom. Linear radicals $R^4$ are preferred. If $R^4$ is branched, it preferably carries this branch in the 2-position. It is possible to us different radicals $R^4$, i.e. to use mixtures of different alcohols in the preparation of the maleic, itaconic and/or fumaric esters.

Preferred alcohols $R^4$-OH are, for example, 1-decanol, 1-dodecanol, 1-tridecanol, isotridecanol, 1-tetradecanol, 1-hexadecanol, 1-octadecanol, eicosanol, docosanol, tetracosanol, mixtures thereof and naturally occurring mixtures, such as, for example, coconut fatty alcohol, tallow fatty alcohol and behenyl alcohol. The alcohols may be of natural as well as synthetic origin.

In a further preferred embodiment, the radicals $R^4$ in formula B1) are alkoxyalkyl radicals of the formula $$—(O—A)_x—R^6 \quad (3)$$

in which A is a $C_2$–$C_4$-alkylene radical, x is an integer from 1 to 100 and $R^6$ is a $C_1$–$C_{30}$-alkyl radical. The (O—A) unit is preferably an ethoxy or propoxy unit. If alkoxylated units of the formula (3) are used for $R^4$, this is preferably effected as a mixture with radicals $R^4$ which are not alkoxylated. The amount of the alkoxylated radicals $R^4$ preferably does not exceed 20 mol % (based on all radicals $R^4$). $R^6$ may be linear or branched. If $R^6$ is branched, the branch is preferably in the 2-position. $R^6$ is preferably linear.

Primary amines having 12 to 30, in particular 12 to 22, carbon atoms, such as dodecylamine, tetradecylamine, hexadecylamine and octadecylamine and mixtures thereof, such as coconut fatty amine and tallow fatty amine, have proven particularly suitable for the imidation (structural units B1b).

The structural units of the formula B2) are derived from α-olefins. These α-olefins have from 10 to 50, preferably from 12 to 40, carbon atoms. Olefins in the range $C_{14}$–$C_{22}$ are particularly preferred. The carbon chain of the α-olefin may be straight or branched and is preferably straight. Examples of suitable olefins are 1-dodecene, 1-tetradecene, 1-tridecene, 1-hexadecene, 1-heptadecene, 1-octadecene, 1-nonadecene, 1-eicosene, 1-hemicosene, 1-docosene, 1-tetracosene, 1-hexacosene, 1-octacosene, etc. and mixtures thereof. Commercially available olefin fractions, such as, for example, $C_{20}$–$C_{24}$-or $C_{30+}$-olefin, are also suitable.

The bivalent structural units stated under B3) are derived from polyolefins which are composed of monoolefins having 3, 4 or 5 carbon atoms. Particularly preferred monoolefins as parent structures of the polyolefins are propylene and isobutylene, from which polypropylene and polyisobutylene form as polyolefins. The polyolefins preferably have an alkylvinylidene content of at least 50 mol %, in particular at least 70 mol %, especially at least 75%. The polyolefins not accessible to the free radical polymerization remain as noncopolymerized components of the product, which also has a positive effect on the miscibility of the esters and mixtures thereof with other polymers. The alkylvinylidene content is understood as meaning the content, in the polyolefins, of structural units which are based on the compounds of the formula

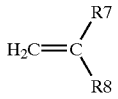

in which $R^7$ or $R^8$ is methyl or ethyl and the other group is an oligomer of the $C_3$–$C_5$-olefin. The number of carbon atoms of the polyolefins is from 35 to 350. In a preferred embodiment of the invention, the number of carbon atoms is from 45 to 250. In a further preferred embodiment of the invention, the content of structural units B3) is from 1 to 20 mol %, in particular from 2 to 15 mol %.

The polyolefins on which the structural units B3) are based are obtainable by ionic polymerization and are available as commercial products (e.g. ®Ultravis, ®Napvis, ®Hyvis, ®Glissopal) (polyisobutenes from BP, BASF having different alkylvinylidene contents and molecular weights).

The average molar mass of the copolymers B) according to the invention is in general from 1500 to 200,000 g/mol, in particular from 2000 to 100,000 g/mol (GPC against polystyrene standards in THF).

The copolymers B) according to the invention are preferably prepared at temperatures of from 50 to 220° C., in particular from 100 to 190° C., especially from 130 to 170° C. The preferred preparation process is solvent-free mass polymerization, but it is also possible to carry out the polymerization in the presence of aromatic, aliphatic or isoaliphatic aprotic solvents, such as toluene, xylene or solvent mixtures, such as kerosene or solvent naphtha. The polymerization in aliphatic or isoaliphatic solvents having little moderating effect is particularly preferred. In the case of the solution polymerization, the temperature can be particularly easily established by means of the boiling point of the solvent or by working under reduced pressure or superatmospheric pressure.

The reaction of the monomers is initiated by free radical initiators (free radial chain initiators). This class of substance includes, for example, oxygen, hydroperoxides, peroxides and azo compounds, such as cumyl hydroperoxide, tert-butyl hydroperoxide, dilauroyl peroxide, dibenzoyl peroxide, bis(2-ethylhexyl) peroxodicarbonate, tert-butyl perpivalate, tert-butyl permaleate, tert-butyl perbenzoate, dicumyl peroxide, tert-butyl cumyl peroxide, di(tert-butyl) peroxide, 2,2'-azobis(2-methylpropanonitrile) or 2,2'-azobis (2-methylbutyronitrile). The initiators are used individually or as a mixture of two or more substances, in amounts of from 0.01 to 20% by weight, preferably from 0.05 to 10% by weight, based on the monomer mixture.

The copolymers can be prepared by copolymerization of polyolefin (component B3) and α-olefin (component B2) with either maleic acid, fumaric acid, itaconic acid, itaconic anhydride or maleic anhydride or maleic, fumaric or itaconic esters or maleimide or itaconimide (component B1). If a copolymerization is carried out using acids or anhydrides, the copolymer formed is esterified or imidated after the preparation. This esterification or imidation is carried out, for example, by reaction with from 1.5 to 2.5 mol of alcohol or from 0.8 to 1.2 mol of amine per mole of anhydride at from 50 to 300, in particular 120–250, ° C. The water of reaction can be distilled off by means of an inert gas stream or discharged by means of azeotropic distillation. Copolymers B) having acid numbers of less than 50, in particular less than 30, especially less than 20, mg KOH/g are preferred.

Preferred additives according to the invention contain 20–85% by weight of one or more copolymers A) and 15–80% by weight of one or more copolymers B, in particular 40–80% by weight of A and 20–60% by weight of B.

The further ethylene copolymers C) contain preferably 8–13 mol % of at least one vinyl ester, such as vinyl acetate, vinyl propionate, vinyl butyrate, vinyl hexanoate, vinyl octanoate, vinyl neononanoate and vinyl neodecanoate, one $C_1$–$C_{30}$-alkyl vinyl ester and/or $C_1$–$C_{30}$-alkyl (meth) acrylate. Furthermore, they contain preferably 1–6 mol % of at least one olefin having 3–8 carbon atoms, such as propene, butene, isobutene, diisobutylene, pentene, hexene, 4-methylpentene, norbornene or octene. Furthermore, mixtures of different flow improvers having different quantitative (e.g. comonomer content) and/or qualitative compositions (type of copolymers/ terpolymers, molecular weight, degree of branching) may also be used. Preferably, the polymers C) have melt viscosities at 140° C. of from 50 to 8000 mPas, especially from 70 to 3000 mPas.

According to a preferred embodiment of the invention, the additives according to the invention are used as a mixture with ethylene/vinyl acetate/vinyl neononanoate terpolymers or ethylene/vinyl acetate/vinyl neodecanoate terpolymers. The terpolymers of vinyl neononanoate or of vinyl neodecanoate contain from 10 to 35% by weight of vinyl acetate and from 1 to 25% by weight of the respective neo compound in addition to ethylene.

In a further preferred embodiment of the invention, the additives according to the invention are used with terpolymers which contain 10–35% by weight of vinyl esters and from 0.5 to 20% by weight of olefins, such as, for example, diisobutylene, hexene, 4-methylpentene and/or norbornene, in addition to ethylene.

The mixing ratio of the additives according to the invention with the ethylene/vinyl acetate copolymers described above or with the terpolymers of ethylene, vinyl acetate and the vinyl esters of neononanoic or of neodecanoic acid or the terpolymers of ethylene, vinyl esters and olefins is (in parts by weight) from 20:1 to 1:20, preferably from 10:1 to 1:10, especially from 5:1 to 1:5. The mixtures of the additives according to the invention with said copolymers are suitable in particular for improving the flowability of middle distillates.

The additives according to the invention are added to mineral oils or mineral oil distillates in the form of solutions or dispersions. These solutions or dispersions contain preferably from 1 to 90, in particular from 5 to 80, % by weight, especially from 10 to 75%, of the mixtures. Suitable solvents or dispersants are aliphatic and/or aromatic hydrocarbons or hydrocarbon mixtures, e.g. gasoline fractions, kerosene, decane, pentadecane, toluene, xylene, ethylbenzene or commercial solvent mixtures, such as Solvent Naphtha, ®Shellsol AB, ®Solvesso 150, ®Solvesso 200, ®Exxsol, ®ISOPAR and ®Shellsol D grades, and aliphatic or aromatic alcohols, ethers and/or esters. Said solvent mixtures contain different amounts of aliphatic and/or aromatic hydrocarbons. The aliphatics may be straight-chain (n-paraffins) or branched (isoparaffins). Aromatic hydrocarbons may be mono-, di- or polycyclic and, if required, carry one or more substituents. Mineral oils or mineral oil distillates improved in their rheological properties by the additives according to the invention contain from 0.001 to 2% by weight, preferably from 0.005 to 0.5% by weight, of the additives, based on the distillate.

For the preparation of additive packets for solutions to specific problems, the additives may also be used together with one or more oil-soluble coadditives which by themselves improve the cold flow properties of crude oils, lubricating oils or fuel oils. Examples of such coadditives are alkylphenol/aldehyde resins and polar compounds which disperse paraffins (paraffin dispersants).

Thus, the additives according to the invention can be used as a mixture with alkylphenol/formaldehyde resins. In a preferred embodiment of the invention, these alkylphenol/formaldehyde resins are those of the formula

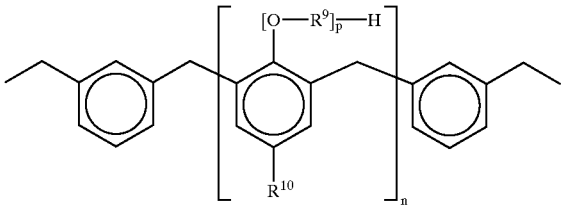

in which $R^{10}$ is $C_4$–$C_{50}$-alkyl or $C_4$–$C_{50}$-alkenyl, $R^9$ is ethoxy and/or propoxy, n is a number from 5 to 100 and p is a number from 0 to 50. Paraffin dispersants reduce the size of the paraffin crystals and ensure that the paraffin particles do not settle out but remain dispersed in colloidal form with substantially reduced tendency to sedimentation. Oil-soluble polar compounds having ionic or polar groups, e.g. amine salts and/or amides, which are obtained by reacting aliphatic or aromatic amines, preferably long-chain aliphatic amines, with aliphatic or aromatic mono-, di-, tri- or tetracarboxylic acids or their anhydrides, have proven to be useful paraffin dispersants. Other paraffin dispersants are copolymers of maleic anhydride and α,β-unsaturated compounds, which may be reacted with primary monoalkylamines and/or aliphatic alcohols, the reaction products of alkenylspirobislactones with amines and reaction products of terpolymers based on α,β-unsaturated dicarboxylic anhydrides, α,β-unsaturated compounds and polyoxyalkylene ethers of lower unsaturated alcohols. Alkylphenol/formaldehyde resins are also suitable as paraffin dispersants.

The mixing ratio (in parts by weight) of the additives with paraffin dispersants is in each case from 1:10 to 20:1, preferably from 1:1 to 10:1.

The additives according to the invention are suitable for improving the cold flow properties of crude oils, distillate oils or fuel oils and lubricating oils. The oils may be of mineral, animal and vegetable origin.

In addition to crude oils and residue oils, middle distillates are particularly suitable as fuel oils. Middle distillates are defined in particular as those mineral oils which are obtained by distillation of crude oil and boil within a range from 120 to 500° C., such as, for example, kerosene, jet fuel, diesel and heating oil. They may contain fractions of alcoholic fuels, such as, for example, ethanol and methanol, or biofuels, such as, for example, rapeseed oil or the methyl ester of rapeseed oil acid. In particular, they are effective in oils whose content, determined by means of GC, of n-paraffins which have chain lengths of 22 carbon atoms or more is at least 1.0% by area, in particular more than 1.5% by area, especially 2.0% by area or more. The 90% distillation point of the oils according to the invention is preferably above 345° C., in particular about 350° C., especially above 355° C. These oils have cloud points above 5° C., in particular above 8° C.

The additives can be used alone or together with other additives, for example with dewaxing assistants, conductivity improvers, antifoams, dispersants, corrosion inhibitors, antioxidants, lubricity additives, dehazers or sludge inhibitors. The additive components may be added to the oils, into which additives are to be introduced, together as a concentrated mixture in suitable solvents or separately.

EXAMPLES

Characterization of the Additives Used

Additives A

A1) Copolymer of ethylene and 35% by weight of vinyl neodecanoate, having a melt viscosity of 200 mPas, measured at 140° C.

A2) Copolymer of ethylene and 31% by weight of vinyl neononanoate, having a melt viscosity of 350 mPas, measured at 140° C.

Additives B

B1) Copolymer of stearylmaleimide and octadecene according to EP-A-0 320 766.

B2) Alternating copolymer of maleic anhydride and octadecene, esterified with a mixture of equal parts of tetradecanol and hexadecanol.

B3) Alternating copolymer of maleic anhydride and a mixture of 9 parts of octadecene and 1 part of poly (isobutylene), esterified with a mixture of 90% of tetradecanol and 10% of behenyl alcohol.

Additives C

C1) Copolymer of ethylene and 28% by weight of vinyl acetate, having a melt viscosity of 300 mPas, measured at 140° C.

C2) Terpolymer of ethylene, 24% by weight of vinyl acetate and 4 mol % of 4-methylpentene, having a melt viscosity of 250 mPas, measured at 140° C.

C3) Mixture of 3 parts of EVA copolymer with 36% by weight of vinyl acetate ($V_{140}$=200 mPas) and 1 part of EVA copolymer with 16% by weight of vinyl acetate ($V_{140}$=350 mPas).

For easier handling and mixing into the oils in which additives are to be introduced, all additives are used as 50% strength solutions in kerosene or Shellsol AB.

Table 1: Characterization of test oils

The boiling characteristics are determined according to ASTM D-86, the CFPP value according to EN 116 and the cloud point according to ISO 3015.

The distribution of the n-paraffins is determined by gas chromatography using an HP 5890 Series II. The separation is effected over a silica gel column containing 5% of crosslinked phenylmethylsilicone (Ø 0.32 mm, length 50 m, film thickness 0.17 μm). The detection is effected by means of a thermal conductivity detector.

For the analysis, 3 μl of the middle distillate are injected into the inlet space heated to 230° C. The column is heated from 40° C. at 5 K/min to 310° C. and is kept at this temperature for 5 minutes.

In order to determine the percentages by area of the n-paraffins, the detected total area of the injected sample is determined in the first step. In the second step, the areas for the individual n-paraffins are determined by a "valley-to-valley" integration. This area divided by the previously determined total area gives the percentages by area of the respective n-paraffin. Thus, the fraction of the area of a peak which is attributable to an n-paraffin is separated from that for the matrix (isomers of n-paraffin, naphthenes and aromatics).

| | Test oil 1 | Test oil 2 | Test oil 3 |
|---|---|---|---|
| Initial boiling point [° C.] | 144 | 139 | 152 |
| 20% [° C.] | 234 | 222 | 231 |
| 90% [° C.] | 363 | 355 | 363 |
| Cloud point [° C.] | +10 | +8 | +16 |
| CFPP [° C.] | +6 | +3 | +9 |
| n-Paraffins ≧ $C_{22}$ | 2.4% | 2.0% | 2.2% |

TABLE 2

| | CFPP efficiency in test oil 1 | | | |
|---|---|---|---|---|
| Example | 100 ppm | 150 ppm | 200 ppm | 250 ppm |
| A1 + B1 (3:1) | +2 | −4 | −5 | −10 |
| A1 + B3 (2:1) | 0 | −5 | −6 | −11 |
| A2 + B2 (2:1) | 0 | −4 | −5 | −10 |
| A1 + C2 + B3 (1:1:1) | −1 | −5 | −8 | −14 |
| A1 + C1 + B2 (1:1:1) | 0 | −4 | −6 | −12 |
| C2 + B1 (2:1) (Comp.) | +4 | 0 | −2 | −9 |
| C3 + B2 (2:1) (Comp.) | +5 | +1 | −3 | −8 |

TABLE 3

| CFPP efficiency in test oil 2 | | | | |
|---|---|---|---|---|
| Example | 100 ppm | 150 ppm | 200 ppm | 250 ppm |
| A1 + B1 (3:1) | | 0 | −3 | −8 |
| A1 + B3 (2:1) | 0 | −2 | −6 | −12 |
| A2 + B2 | +1 | −1 | −2 | −9 |
| A1 + C2 + B3 (1:1:1) | +1 | −6 | −3 | −12 |
| A1 + C1 + B2 (1:1:1) | +1 | −2 | −7 | −10 |
| C2 + B3 (2:1) (Comp.) | +1 | +2 | +1 | −1 |
| C3 + B2 (2:1) (Comp.) | +2 | +2 | −2 | −2 |

TABLE 4

| CFPP efficiency in test oil 3 | | | | |
|---|---|---|---|---|
| Example | 150 ppm | 200 ppm | 300 ppm | 400 ppm |
| A1 + B1 (3:1) | +5 | +4 | +1 | −1 |
| A1 + B3 (2:1) | +5 | +2 | −2 | −3 |
| A1 + C2 + B3 (1:1:1) | +3 | +3 | −3 | −4 |
| A1 + C1 + B2 (1:1:1) | +4 | +3 | −1 | −2 |
| C2 + B3 (2:1) (Comp.) | +8 | +7 | +3 | 0 |
| C3 + B2 (2:1) (Comp.) | +7 | +6 | +3 | +3 |
| A1 (Comp.) | | +7 | +7 | +6 |
| B3 (Comp.) | | | +8 | +3 |

What is claimed is:

1. An additive for improving the cold flow properties of middle distillates, containing from 10 to 95% by weight of copolymers A), from 5 to 90% by weight of copolymers B) and, if required, from 0 to 70% by weight of copolymers C), which correspond to the following formulae:

A) copolymers of lower olefins and vinyl esters, containing

A1) from 85 to 97 mol % of bivalent structural units of the formula $$—CH_2—CR^1R^2— \quad \text{A1}$$

in which $R^1$ and $R^2$, independently of one another, are hydrogen or methyl, and A2) at least 3 mol % of bivalent structural units of the formula

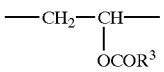

A2 in which $R^3$ is saturated, branched $C_6$–$C_{16}$-alkyl which has a tertiary carbon atom, wherein $R^3$ is bonded with its tertiary carbon atom to the carboxyl function, B) copolymers comprising B1) from 40 to 60 mol % of bivalent structural units of the formula B1 a)

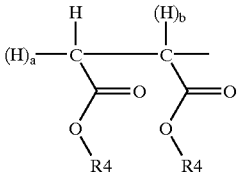

or

-continued

B1 b)

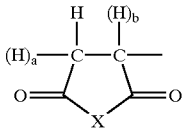

where X is O or N—$R^4$ and in which a and b are 0 or 1 and a+b=1, and

B2) from 60 to 40 mol % of bivalent structural units derived from α-olefins of the formula $$—H_2C—CHR^5— \quad \text{B2}$$

and,

B3) from 0 to 20 mol % of bivalent structural units which are derived from polyolefins, the polyolefins being derived from monoolefins having 3 to 5 carbon atoms and wherein a) $R^4$ is an alkyl or alkenyl radical having 10 to 40 carbon atoms or an alkoxyalkyl radical having 1 to 100 alkoxy units and 1 to 30 carbon atoms in the alkyl radical and b) $R^5$ is an alkyl radical having 10 to 50 carbon atoms and c) the number of carbon atoms of the polyolefin molecules on which the structural units B3) are based is from 35 to 350, and, if required, C) a further copolymer differing from A) and B) and comprising ethylene and one or more vinyl esters or acrylates, which by itself is effective as a cold flow improver for middle distillates.

2. The additive as claimed in claim 1, wherein the melt viscosity of the copolymers A) is from 20 to 10,000 mPas.

3. The additive as claimed in claim 1, wherein the copolymers A) additionally comprise 4% by weight of vinyl acetate or 5 mol % of further comonomers selected from the group consisting of vinyl esters except for vinyl acetate, vinyl ethers, and (meth)acrylates of $C_1$–$C_4$-alcohols and olefins having at least 5 carbon atoms.

4. The additive as claimed in claim 1, wherein $R^4$ in formula B1 is $C_{10}$–$C_{24}$-alkyl.

5. The additive as claimed in claim 1, wherein the α-olefins of the formula B2 have chain lengths of from 14 to 22 carbon atoms.

6. The additive as claimed in claim 1, wherein the ethylene copolymer C) is a copolymer which, in addition to ethylene, comprises from 8 to 13 mol % of at least one vinyl ester of a $C_2$–$C_{12}$-carboxylic acid or one $C_1$–$C_{30}$-alkyl methacrylate.

7. The additive as claimed in claim 1, wherein the ethylene copolymer C) is a copolymer which, in addition to ethylene, comprises from 8 to 13 mol % of at least one vinyl ester of a $C_2$–$C_{12}$-carboxylic acid or one $C_1$–$C_{30}$-alkyl methacrylate, and from 1 to 6 mol % of at least one olefin having 3 to 8 carbon atoms.

8. A fuel oil comprising a middle distillate and from 0.001 to 2% by weight of the additive as claimed in claim 1.

9. The fuel oil of claim 8 wherein the middle distillate comprises a cloud point above 5° C.

10. The fuel oil of claim 8 wherein the middle distillate comprise n-paraffins having a chain length of 22 or more carbon atoms.

11. The fuel oil of claim 10 wherein the middle distillate comprises at least 1 percent of said n-paraffins.

12. A process for improving the cold flow properties of a middle distillate comprising adding the additive of claim 1 to the middle distillate.

* * * * *